United States Patent [19]

Lemaire

[11] Patent Number: 4,823,463

[45] Date of Patent: Apr. 25, 1989

[54] POCKET-KNIFE HAVING A HANDLE PROVIDED WITH A SLIDABLE BLADE

[76] Inventor: Denis Lemaire, 534 de la Vérendrye,, Boucherville (Québec), Canada, J4B 2Y1

[21] Appl. No.: 217,166

[22] Filed: Jul. 11, 1988

[30] Foreign Application Priority Data

Jul. 13, 1987 [GB] United Kingdom ..... 8716418

[51] Int. Cl.[4] ..... B26B 1/08

[52] U.S. Cl. ..... 30/162; 30/335

[58] Field of Search ..... 30/151, 162, 163, 164, 30/335, 337

[56] References Cited

U.S. PATENT DOCUMENTS

| | | | |
|---|---|---|---|
| 110,986 | 1/1871 | Lyman | 30/163 |
| 1,647,405 | 11/1927 | Giesen . | |
| 2,250,290 | 7/1941 | Berg . | |
| 2,662,284 | 12/1953 | Unsinger | 30/162 |
| 2,735,176 | 2/1956 | Costin | 30/162 |
| 4,354,313 | 10/1982 | Naifeh . | |
| 4,604,803 | 8/1986 | Sawby . | |

FOREIGN PATENT DOCUMENTS

| | | | |
|---|---|---|---|
| 444113 | 7/1946 | Canada . | |
| 2208782 | 8/1973 | Fed. Rep. of Germany | 30/335 |

*Primary Examiner*—Frank T. Yost
*Assistant Examiner*—Michael D. Folkerts
*Attorney, Agent, or Firm*—Nixon & Vanderhye

[57] ABSTRACT

The present disclosure describes a pocket-knife having a handle. The pocket-knife comprises a front component having a pivotal plate provided with a slot having a recess at each of its extremities, a blade having an extremity to be moved out from the handle, a pin connected to the other extremity of the blade and being adapted to slide along the slot, and a back component forming with the front component a channel with an opening into which said blade can slide. The blade is slid by positioning the pivotal plate in a first position in which the pin can be slid by a user along the slot to move the blade along the channel. The blade is locked outside or inside the handle by positioning the pivotal plate in a second position in which the pin is either located in the recess of the slot adjacent to the opening to lock the blade outside or in the other recess of the slot to lock the blade inside. The pocket-knife also comprises a spring for automatically retracting the blade inside the handle when the pivotal plate is in the first position.

4 Claims, 3 Drawing Sheets

POCKET-KNIFE HAVING A HANDLE PROVIDED WITH A SLIDABLE BLADE

FIELD OF THE INVENTION

The present invention relates to a pocket-knife and more particularly to a pocket-knife with a blade that can be slid in and out of the handle.

BACKGROUND OF THE INVENTION

Previously known pocket knives with blades sliding in and out of the handle such as the ones commonly referred to as "gravity-knives" are considered illegal in many countries.

OBJECTS OF THE INVENTION

An object of this invention is to provide a pocket-knife allowing sliding action of the blade in the handle but comprising a device which by restraining this action allows the knife to meet legal criteria.

Another object of this invention is to provide a pocket-knife which is easy to use, safe and ergonomical.

The objects, advantages and other features of the present invention will become more apparent upon reading of the following non restrictive description of preferred embodiments thereof, given for the purpose of examplification only with reference to the accompanying drawings.

SUMMARY OF THE INVENTION

According to the present invention, there is provided a pocket-knife having a handle comprising:

- a front component having a pivotal plate provided with a slot having a recess at each of its extremities, said pivotal plate being provided with a pivotal connection for pivotal movement;
- a blade having an extremity to be moved out from the handle;
- a pin connected to the other extremity of the blade and being adapted to slide along said slot, said pin having an extremity emerging from said slot;
- a back component forming with said front component a channel with an opening into which said blade can slide longitudinally inside said handle, said blade being slid by positioning said pivotal plate in a first position in which said pin can be slid by a user along said slot to move said blade along said channel, said blade being locked outside or inside said handle by positioning said pivotal plate in a second position in which said pin is either located in the recess of the slot adjacent to said opening to lock said blade outside or in the other recess of the slot to lock said blade inside; and
- resilient means having one of its ends attached to the blade, and its other end attached to a portion of the handle distal to said opening so that said blade is automatically retracted inside said handle when said pivotal member is in said first position.

DETAILED DESCRIPTION OF THE DRAWINGS

Figures 1, 2, 3, 4:
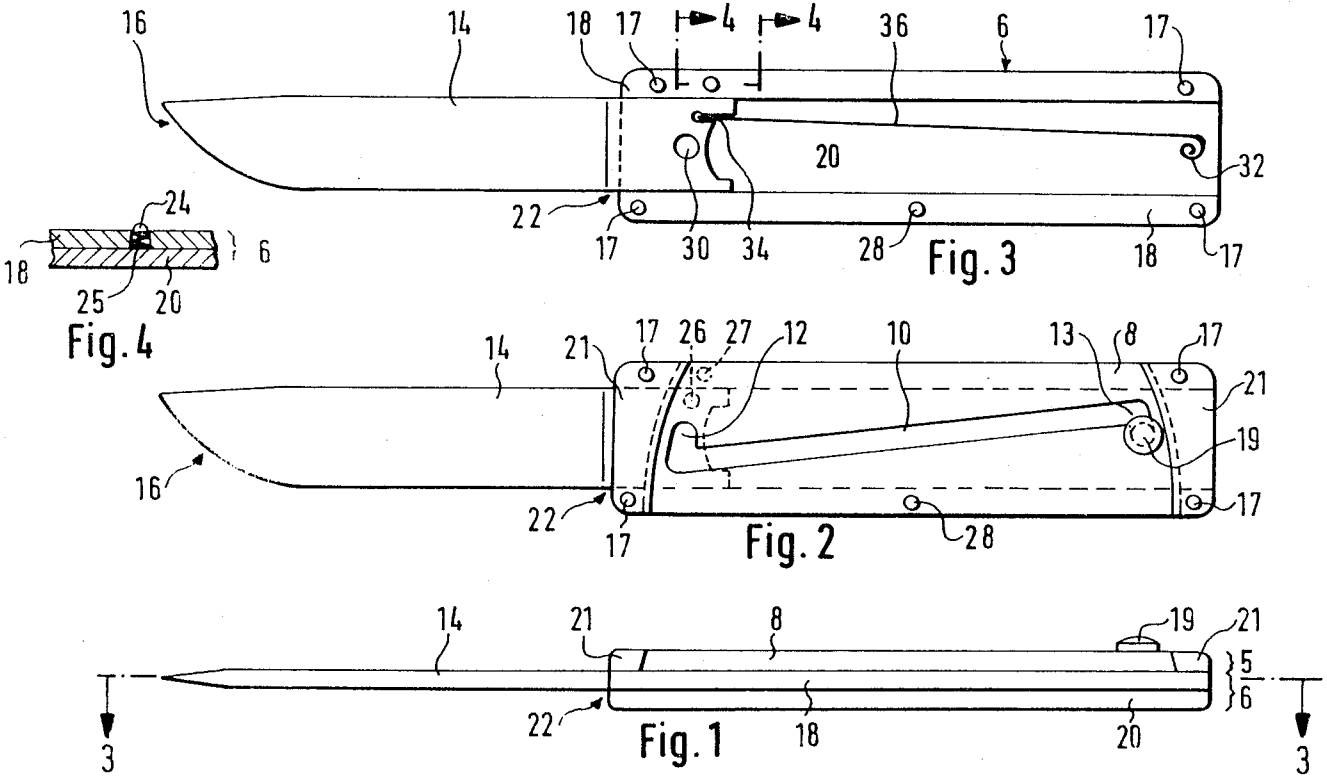
FIG. 1 is a view from above of a pocket-knife according to the present invention.
FIG. 2 is a schematic side view of the knife shown in FIG. 1.
FIG. 3 is a sectional view along lines 3—3 of the knife shown in FIG. 1.
FIG. 4 is a cross sectional view along lines 4—4 of the knife shown in FIG. 3.
Figure 6:
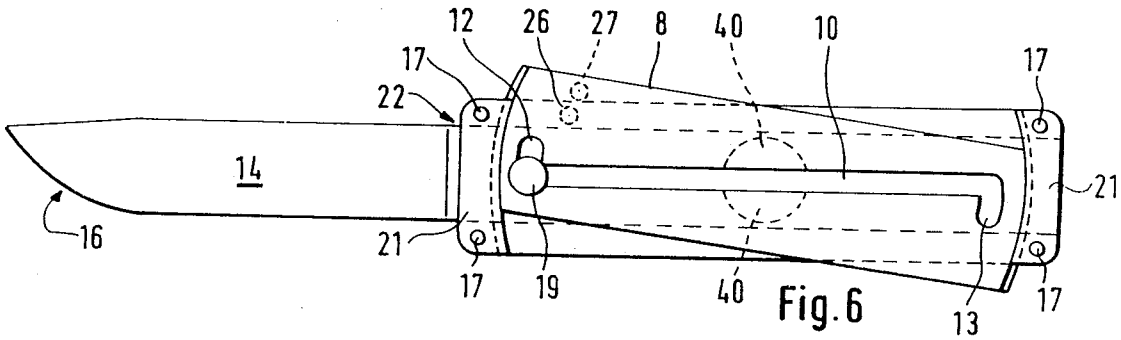
FIG. 6 is a schematic side view of the knife shown in FIG. 5.
Figure 5:
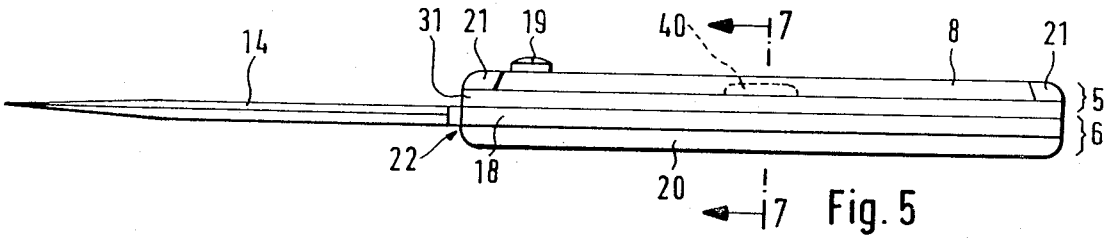
FIG. 5 is a view from above of another pocket-knife according to the present invention.
Figure 7:
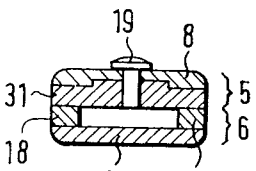
FIG. 7 is a cross sectional view along lines 7—7 of the knife shown in FIG. 5.
Figure 8:
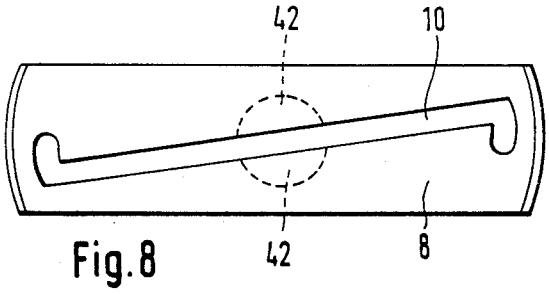
FIG. 8 is a side view of the pivotal plate of the knife shown in FIG. 6.
Figure 9:
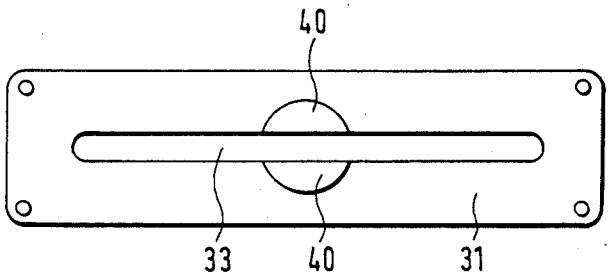
FIG. 9 is a side view of the additional plate of the knife shown in FIG. 6.

Referring now to FIGS. 1 to 4, there is shown a pocket-knife having a handle according to the present invention. The handle comprises a front component 5 having a pivotal plate 8 provided with a slot 10 having a recess 12 and 13 at each of its extremities. The pivotal plate 8 is provided with a pivotal connection 28 for pivotal movement. The blade 14 has an extremity 16 to be moved out from the handle. The other extremity of the blade has a hole 30 into which is inserted a pin 19 adapted to slide along the slot 10. As it can be seen in FIG. 1, a portion of the pin 19 emerges from the slot 10. The handle also comprises a back component 6 forming with the front component 5 a channel with an opening 22 into which the blade 14 can slide longitudinally inside the handle.

The handle is also provided with a locking mechanism 24, 25 and 27 for locking the pivotal plate 8 either in a first position wherein the pin 19 can be slid by a user along the slot 10 to move the blade 14 inside the channel, or in a second position wherein the pin 19 is either positioned in the recess 12 of the slot 10 adjacent to the opening 22 to lock the blade 14 outside of the handle or in the other recess 13 of the slot 10 to lock the blade 14 inside the handle.

A resilient metal spring 36 has one 34 of its ends attached to the blade 14, and its other end 32 attached to a portion of the back component distal from the opening 22 so that the blade 14 is automatically retracted inside the handle when the pivotal plate 8 is in the first position. This spring restrains the sliding motion of the blade in and out of the handle. The spring can be of any type such as the conventional known spiral springs or another mechanism which would restrain the sliding motion. The end of the blade adjacent to the hole 30 is shaped in such a fashion that it does not interfere with the coil of the spring 36 when the blade is completely inserted in the handle.

The back component 6 comprises a back plate 20 having elongated members 18 along its longitudinal sides for spacing the back plate 20 from the front component 5.

The locking mechanism comprises a small steel ball 24 supported by a spring 25 inserted in a small cavity formed in one of the elongated members 18 as shown in FIG. 4. The locking mechanism also comprises two small cavities 26 and 27 formed on the interior surface of the pivotal plate 8. This locking mechanism helps to prevent involuntary rotation of the pivotal plate 8.

The front component 5 also comprises two small plates 21 disposed adjacently to the extremities of the pivotal plate 8. These small plates 21 are rigidly fixed to the back component 6 by fastening means 17 such as rivets or screws.

As it can be seen in FIGS. 1 and 2, the portions of the small plates 21 adjacent to the corresponding portions of the pivotal plate 8 are made to fit together according to a specific shape so that the pivotal plate 8 can pivot around the pivotal connection 28. The contact surfaces between the small plates 21 and the pivotal plate 8 are shaped according to a specific angle so that the pivotal plate 8 is disposed between the contact surfaces of the small plates 21 on one side, and the elongated members 18 on the other side.

The pivotal connection 28 is connected to one of the elongated members 18 by means of a pin.

Referring now to FIGS. 6 to 9, there is shown another pocket-knife according to the present invention. The handle comprises also a front component 5 and a back component 6. The back component 6 is similar to the one of the knife shown in FIGS. 1 to 4. The front component comprises an additional plate 31 provided with a slot 33 having a shape substantially similar to the shape of the pivotal member slot 10 without the recesses. The additional plate 31 has on its surface facing the pivotal plate 8 two salient parts 40 disposed respectively on each side of its slot 33 about the middle thereof. The salient parts 40 form a pivot from the pivotal plate 8. The pivotal plate 8 has a cavity to receive the salient parts to form a pivotal connection.

This pocket-knife also comprises a resilient steel spring for automatically retracting the blade into the handle when the pivotal member is in the first position. This resilient steel spring is arranged in a manner similar to the one shown in FIGS. 1 to 4.

The other elements of these figures are similar to the corresponding elements of FIGS. 1 to 3, and are represented by the same numerals.

In operation, when the blade rests inside the handle, the pin 19 is located in the recess 13, and the small steel ball 24 is located in the small cavity 27 of the pivotal plate 8. To move the blade out of the handle, the user applies a pressure onto the pivotal plate 8 to pivot it so that the recess 13 that locks the pin 19 is displaced to unlock the blade 14. In this position, the pin 19 is free to slide along the slot 10. Then, the user applies a pressure on the pin 19 to move it along the slot 10 and consequently moves the blade 14 out of the handle. At this point, the user has to move the blade against the retracting force of the resilient steel spring 36. When the pin has reached the portion of the slot 10 adjacent to the recess 12, the user can pivot the pivotal plate 8 back to its previous position to position the pin 19 in the recess 12 of the slot 10. In this position, the blade 14 is locked outside of the handle.

To bring back the blade inside the handle, the user pivot the pivotal member 8 so that the recess 12 that locks the pin 18 is displaced to unlock the blade 14; then, the blade is automatically brought back inside the handle by means of the resilient steel spring 36.

Althought, the present invention has been explained hereinabove by way of preferred embodiments thereof, it should be point out that any modification to these preferred embodiments, within the scope of the appended claims is not deemed to change or alter the nature and scope of the invention.

The embodiments of the invention in which an exclusive property or privilege is claimed are defined as follows:

1. A pocket-knife having a handle comprising:

a front component having a pivotal plate provided with a slot having a recess at each of its extremities, said pivotal plate being provided with a pivotal connection for pivotal movement;

a blade having an extremity to be moved out from the handle;

a pin connected to the other extremity of the blade and being adapted to slide along said slot, said pin having an extremity emerging from said slot;

a back component forming with said front component a channel with an opening into which said blade can slide longitudinally inside said handle, said blade being slid by positioning said pivotal plate in a first position in which said pin can be slid by a user along said slot to move said blade along said channel, said blade being locked outside or inside said handle by positioning said pivotal plate in a second position in which said pin is either located in one of said recesses of the slot adjacent to said opening to lock the blade outside or in the other of said recesses of the slot to lock the blade inside; and resilient means having one of its ends attached to the blade, and its other end attached to a portion of the handle distal from said opening so that said blade is automatically retracted inside said handle when said pivotal plate is in said first position.

2. A pocket-knife according to claim 1, wherein said pivotal connection is connected to said back component by means of a pin.

3. A pocket-knife according to claim 1, wherein said front component comprises an additional plate provided with a slot having a shape substantially similar to the shape of the pivotal plate slot without said recesses, said additional plate having on its surface facing said pivotal plate two salient parts disposed respectively on each side of its slot about the middle portion thereof, said salient parts forming a pivot; and wherein the pivotal connection of said pivotal plate has a cavity to receive said pivot.

4. A pocket-knife according to claim 1, further comprising a locking means including a steel ball supported by a spring located in a cavity formed in said back component, the pivotal plate being provided with two adjacent cavities located on its interior surface, facing said steel ball; in said first position, one of the adjacent cavities being located over said steel ball to lock said pivotal plate in said first position; in said second position, the other adjacent cavity being located over said steel ball to lock said pivotal plate in said second position.

* * * * *